US005913693A

United States Patent [19]

Fetterolf

[11] Patent Number: 5,913,693

[45] Date of Patent: Jun. 22, 1999

[54] ELECTRIC CORD CLIP DEVICE

[76] Inventor: David A. Fetterolf, 435 Radcliff St., #13, Bristol, Pa. 19007

[21] Appl. No.: 09/099,374

[22] Filed: Jun. 18, 1998

[51] Int. Cl.[6] ..... H01R 13/54

[52] U.S. Cl. ..... 439/369; 24/459

[58] Field of Search ..... 434/367, 369, 434/371, 304, 350, 502, 338, 339, 368, 778, 779, 781, 831, 832, 848, 825, 356; 24/459, 589

[56] References Cited

U.S. PATENT DOCUMENTS

| | | | |
|---|---|---|---|
| 3,613,046 | 10/1971 | Kirk | 439/369 |
| 4,596,430 | 6/1986 | Olson | 439/369 |
| 4,940,424 | 7/1990 | Odbert | 439/369 |
| 5,685,732 | 11/1997 | Lane | 439/369 |
| 5,713,753 | 2/1998 | Bayer et al. | 439/369 |

*Primary Examiner*—Steven L. Stephan
*Assistant Examiner*—Michael C. Zarroli
*Attorney, Agent, or Firm*—Henderson & Sturm

[57] ABSTRACT

An electrical cord clip device 10 for captively engaging electrical cords 100, 200 having a female receptacle 102 and a male plug 202 joined together in mating fashion. The device 10 includes first 20 and second 40 pairs of mirror image coupler members wherein a pair of pivoted arm members 30 are pivotally connected to one pair 20 of coupler members and releasably engageable with the other pair 40 of coupler members.

6 Claims, 2 Drawing Sheets

ELECTRIC CORD CLIP DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of electrical plug retention devices in general, and in particular to a dual pivoted arm cord clip device for maintaining the male and female components of the electrical coupling in a mating engagement.

2. Description of Related Art

As can be seen by reference to the following U.S. Pat. Nos. 4,596,430; 4,940,424; 5,685,732; and 5,713,753, the prior art is replete with myriad and diverse electrical plug coupling arrangements.

While all of the aforementioned prior art constructions are more than adequate for the basic purpose and function for which they have been specifically designed, they are uniformly deficient with respect to their failure to provide a simple, efficient, and practical electrical cord clip device that can easily be connected to the electrical cords associated with a conventional male/female electrical connector to maintain the electrical connector in a mating engagement.

As most people are aware, the disengagement of conventional electrical connectors are very dangerous for computer programs and potentially deadly for young children who may be tempted to stick foreign objects into a "live" female receptacle.

As a consequence of the foregoing situation, there has existed a longstanding need for a new and improved type of electrical cord clip device that can be adapted to virtually all electrical cords associated with conventional electrical connectors to maintain the connectors in mating fashion, and the provision of such a construction is a stated objective of the present invention.

BRIEF SUMMARY OF THE INVENTION

Briefly stated, the electrical cord clip device that forms the basis of the present invention comprises in general, a coupler pivot unit, a pair of pivoted arm units, and a coupler catch unit, wherein the pair of pivoted arm units are pivotally connected to the coupler pivot unit and releasably engaged with the coupler catch unit.

As will be explained in greater detail further on in the specification, both the coupler pivot unit and the coupler catch unit comprise pairs of mirror image coupler members wherein the inboard ends of each of the coupler members are identical and wherein the outboard end of the respective pairs of coupler members are different from one another.

In addition, the pivoted arm units comprise a pair of elongated tapered pivoted arm members having one end pivotally connected to the outboard portion of one pair of coupler members wherein the other end of the arm members are releasably engageable with the outboard portion of the other pair of coupler members.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
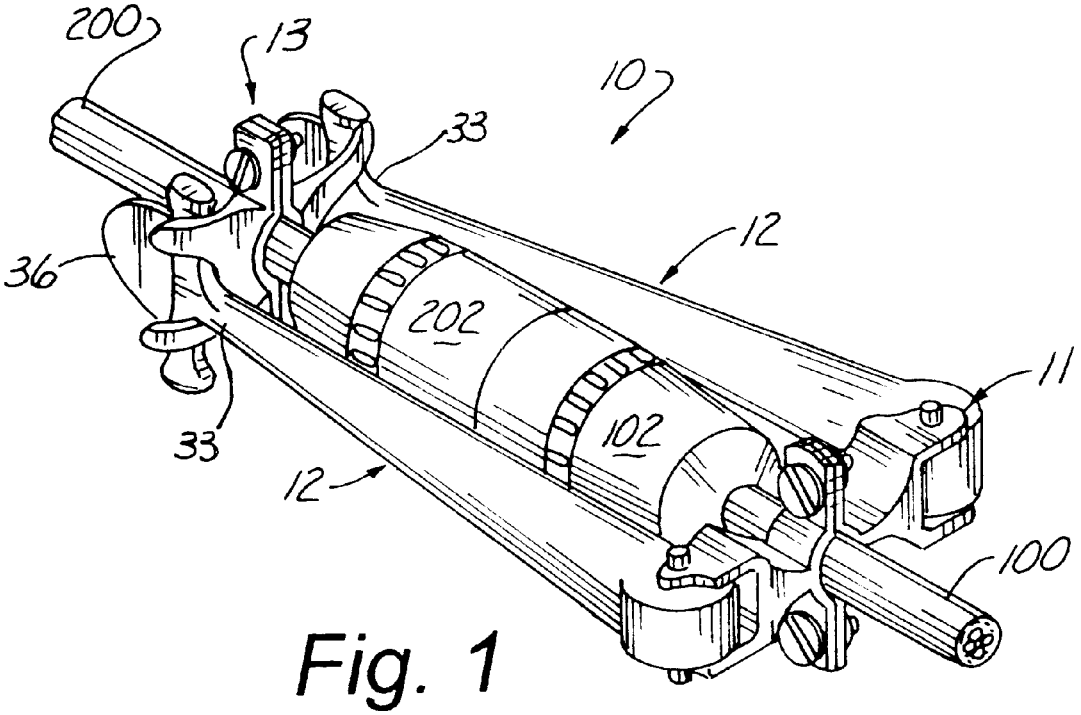
FIG. 1 is a perspective view of the cord clip device that forms the basis of the present invention.

As can be seen by reference to the drawings, and in particularly to FIG. 1, the cord clip device that forms the basis of the present invention is designated generally by the reference number 10. The device 10 comprises in general, a coupler pivot unit 11, a pair of pivoted arm units 12, and a coupler catch unit 13. These units will now be described in seriatim fashion.

As shown in FIGS. 1 through 4, the coupler pivot unit 11 comprises a first pair of mirror image coupler members 20 which are designed and configured to captively engage an electrical cord 100 that is provided with a conventional electrical connector component 101 such as a female receptacle 102.

In addition, each of the first mirror image coupler members 20 have a generally C-shaped inboard bracket element 21 and a generally Y-shaped outboard extension element 22 wherein the stem portion 23 of the extension element 22 projects outwardly from the center of the generally C-shaped inboard bracket element 21 and each of the arm portions 24 of the extension element 22 are provided with a discrete aperture 25 whose purpose and function will be described presently.

Figure 2:
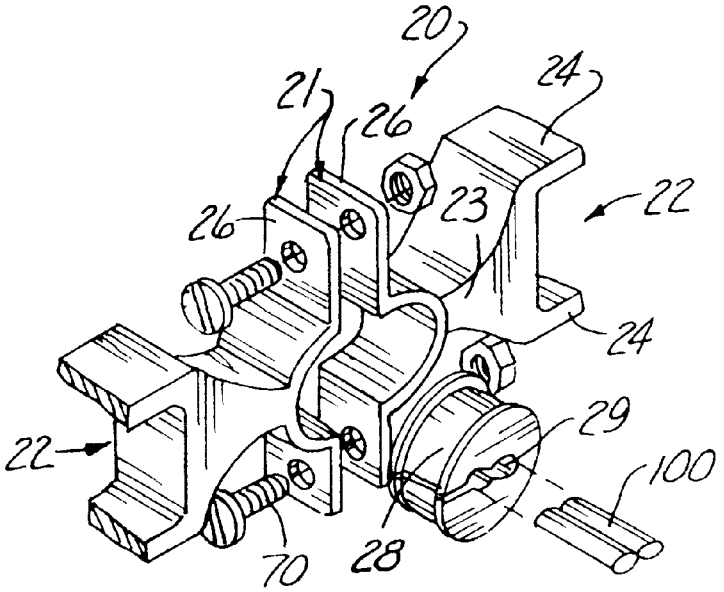
FIG. 2 is an isolated detail view of an adapter disk that may be employed with the coupler pivot unit on one end of the device.
Figure 4:
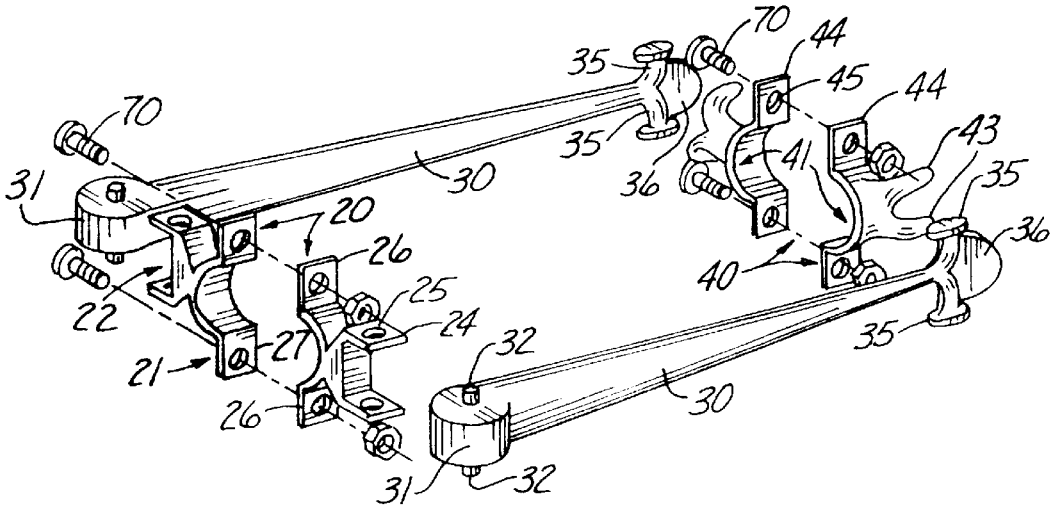
FIG. 4 is an isolate d exploded perspective view of the device.

Furthermore, as shown in FIGS. 2 and 4, the C-shaped inboard bracket elements 21 are provided with flanged ends 26 having apertures 27 dimensioned to secure fastening members 70 for operatively connecting the bracket elements 21 to one another and to captively engage the periphery of a conventional electrical cord 100.

However, in those instances wherein the diameter of the cord 100 is undersized and/or non-uniform as shown in FIG. 2, this invention also contemplates the provision of an adapter grommet 28 dimensioned to be received between the bracket elements 21 and provided with a contoured slot 29 dimensioned to receive the periphery of the electrical cord 100.

Figure 3:
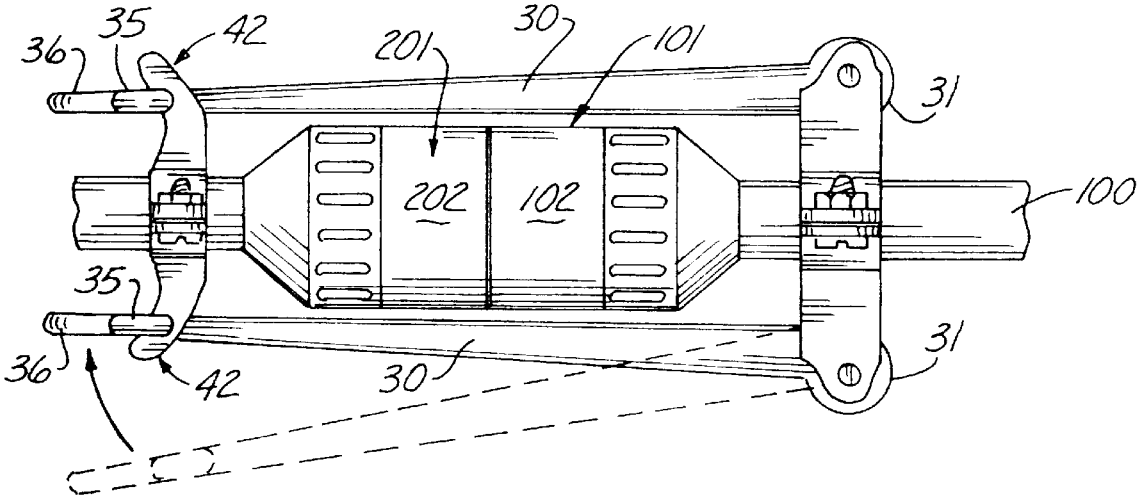
FIG. 3 is a top plan view of the device.

As shown in FIGS. 1, 3, and 4, the pair of pivoted arm units 12 each comprise an elongated tapered arm member 30 having an enlarged generally disk shaped end 31 provided with a pair of centrally disposed pivot post elements 32 which are dimensioned to be received in discrete apertures 25 in the arm portions 24 of the generally Y-shaped extension elements 22 of the first pair of coupler members 20.

In addition, the tapered end 33 of each of the pivoted arm members 30 are further provided with a pair of contoured outwardly projecting catch tabs 35 having an extension element 36 wherein the purpose and function of the tabs 35 and extension element 36 will be described presently.

As can also be seen by reference to FIGS. 1, 3, and 4, the coupler catch unit 13 comprises a second pair of mirror image coupler members 40 which are designed and configured to captively engage another electrical cord 200 that is provided with another conventional electrical connector component 201 such as a male plug member 202.

In addition, each of the second mirror image coupler members 40 also have a generally C-shaped inboard bracket element 41 and an outboard extension element 42 which is provided with a pair of outwardly and upwardly projecting finger prongs 43 which are dimensioned to captively engage the catch tabs 35 on the tapered end 33 of each of the pivoted arm members 30 wherein the extension elements 36 are provided to assist the user in maneuvering the pivoted arm member 30 into and out of operative engagement with the finger prongs 43.

As can best be seen by reference to FIG. 4, each of the generally C-shaped inboard bracket elements 41 are provided with a pair of end flanges 44 having apertures 45 for receiving conventional fastening members 70 for operatively connecting the bracket elements 41 together to captively engage the periphery of the conventional electrical cord 200.

As shown in FIGS. 1 and 3 when the pivoted arm members 30 are disposed with the catch tabs 35 engaged in the finger prongs 43 of the coupler catch unit 13, the female receptacle 102 cannot be disengaged from mating engagement with the male plug 202 until both of the pivoted arm members 30 are disengaged from the finger prongs 43.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An electrical cord clip device for joining a male plug provided with an electrical cord to a female receptacle provided with an electrical cord wherein the device comprises:

a coupler pivot unit including a first pair of mirror image coupler members wherein each coupler member is provided with a generally C-shaped inboard bracket element provided with means for joining the inboard bracket elements together to captively engage one of the electrical cords;

a coupler catch unit including a second pair of mirror image coupler members wherein each coupler member is provided with a generally C-shaped inboard bracket element provided with means for joining the inboard bracket elements together to captively engage the other of the electrical cords; and a pair of pivoted arm members having one end operatively and pivotally connected to one of said first and second pairs of mirror image coupler members and having the other end releasably engageable with the other of said first and second pairs of mirror image coupler members, wherein the inboard bracket elements of one of said first and second pairs of mirror image coupler members are each provided with a generally Y-shaped outboard extension element.

2. The device as in claim 1 wherein the generally Y-shaped extension element has a stem portion which extends outwardly from the center of the generally C-shaped inboard bracket element, and a pair of arm portions which pivotally receive said one end of one of the pivoted arm members.

3. The device as in claim 2 wherein the other end of each of the pair of pivoted arm members are provided with a pair of outwardly extending catch tabs.

4. The device as in claim 3 wherein the inboard bracket elements of the other of said first and second pairs of mirror image coupler members are each provided with a pair of outwardly projecting finger prongs which are dimensioned to captively engage the pair of catch tabs on said other end of each pivoted arm member.

5. The device as in claim 1 wherein each of the generally C-shaped inboard bracket elements are provided with a plurality of end flanges adapted to receive fastening elements for joining the pairs of inboard bracket elements together.

6. The device as in claim 4 wherein each pair of outwardly extending catch tabs are provided with an extension element.

* * * * *